US005868348A

United States Patent [19]

Bulman

[11] Patent Number: 5,868,348

[45] Date of Patent: Feb. 9, 1999

[54] REEL ASSEMBLY

[75] Inventor: Leonard C. Bulman, Postville, Iowa

[73] Assignee: Reel-Core, Inc., Waukon, Iowa

[21] Appl. No.: 22,284

[22] Filed: Feb. 11, 1998

[51] Int. Cl.[6] ..... B65H 75/14

[52] U.S. Cl. ..... 242/608.5; 242/118.62; 242/609.3

[58] Field of Search ..... 242/608.2, 608.5, 242/609.3, 610.6, 118.61, 118.62

[56] References Cited

U.S. PATENT DOCUMENTS

| | | |
|---|---|---|
| 156,413 | 11/1874 | Darrow . |
| 1,846,397 | 2/1932 | Kennedy . |
| 1,984,244 | 12/1934 | Wilson . |
| 2,141,610 | 12/1938 | Little . |
| 2,527,519 | 10/1950 | Bliss . |
| 2,542,554 | 2/1951 | Miller . |
| 2,546,253 | 3/1951 | Beauregard . |
| 2,663,073 | 12/1953 | Bieber . |
| 2,837,297 | 6/1958 | Moss . |
| 3,104,851 | 9/1963 | Portal . |
| 3,523,550 | 8/1970 | Richardson . |
| 3,822,841 | 7/1974 | Campbell . |
| 3,846,887 | 11/1974 | Woods . |
| 4,083,450 | 4/1978 | La Mar . |
| 4,462,555 | 7/1984 | Olson . |
| 5,379,965 | 1/1995 | Isler . |
| 5,415,362 | 5/1995 | Lorenzo . |
| 5,743,486 | 4/1998 | Bulman ..... 242/608.5 |

FOREIGN PATENT DOCUMENTS

| | | |
|---|---|---|
| 140978 | 7/1930 | Switzerland . |
| 464623 | 12/1968 | Switzerland . |

*Primary Examiner*—Donald P. Walsh
*Assistant Examiner*—William A. Rivera
*Attorney, Agent, or Firm*—Henderson & Sturm

[57] ABSTRACT

A reel assembly comprised of a core having threaded ends and end flanges attached to the threaded ends. The flanges are adapted to be attached to or removed from the threaded ends of the core for retaining the material rolled onto the core. A locking web is provided on the flanges and a locking tab is provided on the core to hold the flanges securely to the core when the reel is to be used. The locking mechanism comprises a locking tab having an inclined edge disposed to extend out from each end of the core and a mating web including an inclined edge disposed on the flanges. When the flanges are fully threaded onto the core, the inclined edge of the web engages the inclined edge of the tab to prevent inadvertent unthreading.

10 Claims, 2 Drawing Sheets

REEL ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

AUTHORIZATION PURSUANT TO 37 C.F.R. §1.71 (d)(e)

A portion of the disclosure of this patent document, including appendices, may contain material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND OF THE INVENTION

1. Field of the Invention

The present invention relates generally to reels for storing hose, cable, wire and the like, and more particularly to a molded plastic reel having a core section and two end flange sections which can be releasably connected to the ends of the core.

2. Description of the Related Art

There are many reels available for holding hose, cable, wire or the like. Most of these reels are constructed of wood or metal or both. A major problem with the prior art wooden or metal reels is that they are heavy and cannot be easily disassembled for shipping. Consequently, they cannot nest easily with one another, and because of their weight, shipping costs are increased. Furthermore, these prior art reels are not recyclable as is the case with objects made of certain types of plastics.

It is, of course, much easier for shipping and handling if the flanges and cores remain separate until they are ready to be used. Although reels are available that can be knocked down where the end flanges are removed for shipping, known reels have major disadvantages. Some knockdown reels, for example, include a threaded connection between the core and the flanges where the flanges may be inadvertently loosened and removed. Structures used to prevent this unintentional removal have been very complicated and difficult to use.

Those concerned with these and other problems recognize the need for an improved reel assembly.

BRIEF SUMMARY OF THE INVENTION

The present invention discloses a reel assembly comprised of a core having threaded ends and end flanges attached to the threaded ends. The flanges are adapted to be attached to or removed from the threaded ends of the core for retaining the material rolled onto the core. A locking web is provided on the flanges and a locking tab is provided on the core to hold the flanges securely to the core when the reel is to be used. The locking mechanism comprises a locking tab having an inclined edge disposed to extend out from each end of the core and a mating web including an inclined edge disposed on the flanges. When the flanges are fully threaded onto the core, the inclined edge of the web engages the inclined edge of the tab to prevent inadvertent unthreading.

An object of the present invention is to provide an improved reel assembly.

Another object of the present invention is to provide a reel assembly which is constructed of a core which is separable for shipping and handling purposes from the flanges and which can be easily assembled when it is desired to use the reel.

A further object of the present invention is to provide a reel assembly which is light, easy to ship and transport, easy to assemble and which can be recycled when its usefulness has diminished.

A still further object of the present invention is to provide a method and apparatus for quickly and easily threading flanges onto the ends of the core with locking devices which will securely hold the flanges onto the ends of the core.

BRIEF DESCRIPTION OF THE SEVERAL VIEWS OF THE DRAWINGS

Other objects, advantages, and novel features of the present invention will become apparent from the following detailed description of the invention when considered in conjunction with the accompanying drawings, wherein.

DETAILED DESCRIPTION OF THE INVENTION

Figure 1:
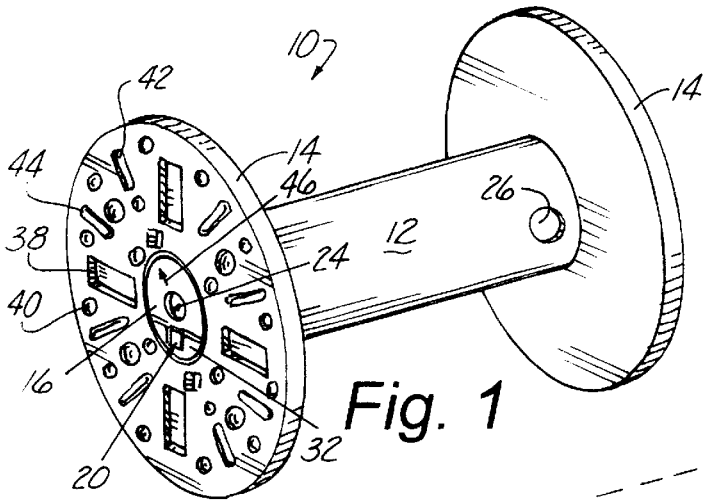
FIG. 1 is a perspective view of a reel constructed in accordance with the present invention.

Referring now to the drawings, wherein like reference numerals designate identical or corresponding parts throughout the several views, FIG. 1 shows a reel 10 constructed in accordance with the present invention and having a core 12 with flanges 14 attached to each end thereof. The flanges 14 are substantially identical.

Figure 2:
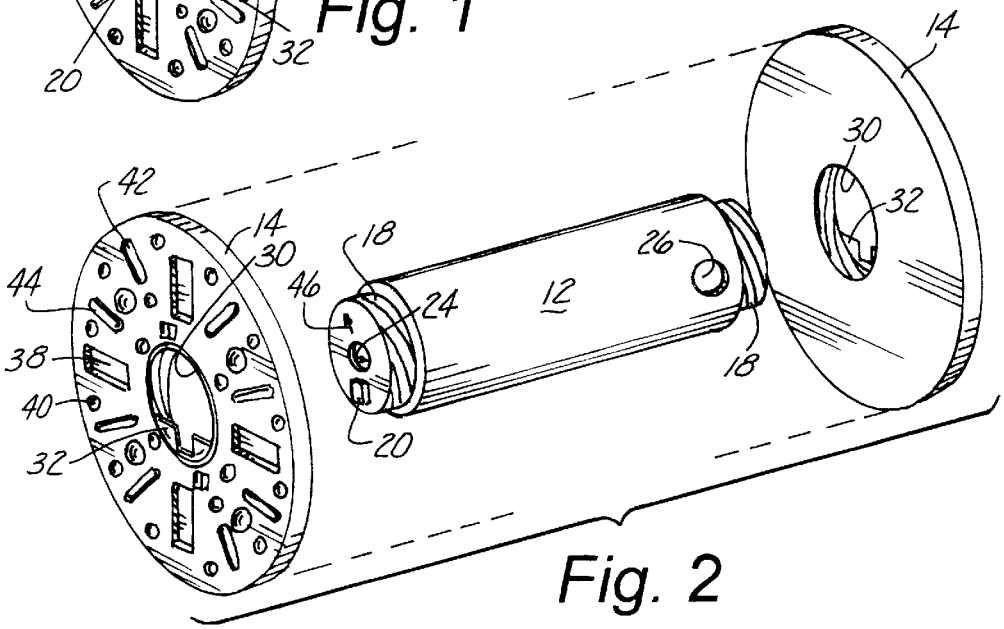
FIG. 2 is an exploded perspective view of the reel of FIG. 1 showing a core and the two side flanges positioned to be threadably attached to the core.

Referring to FIG. 2, it is noted that the core 12 is essentially blow-molded and is hollow. A flat and planar end portion 16 is disposed on each end thereof. Threads 18 are sequentially formed at each end and a tab 20 is formed on the flat and planar end portions 16. The tabs 20 extend out from the end portions 16 and include edges 22 inclined from vertical about 15°. An opening 24 is disposed in each of the end portions 16 so that a shaft (not shown) can be extended therethrough in order to rotatably mount the reel 10 as is conventional. Also, an opening 26 is formed in the sidewall of the core 12 to receive a hose or cable end.

Each of the flanges 14 also has a threaded opening 30 which is complementary to the threads 18 on the core 12. The flanges 14 are also hollow and blow-molded from polyethylene plastic, as is the core 12.

The threaded opening 30 in each center portion of each flange 14 also has a web 32 extending out from the outer face of each flange 14. The web 32 extends across a chord of the circular threaded opening 30, and a pair of spaced inclined edges 34 form an open slot 36. The tabs 20 of the core 12 engage the web slots 36 of the flanges 14 when the core 12 and flanges 14 all fully threaded together as best shown in FIGS. 5, 6, 9 and 10.

Figure 3:
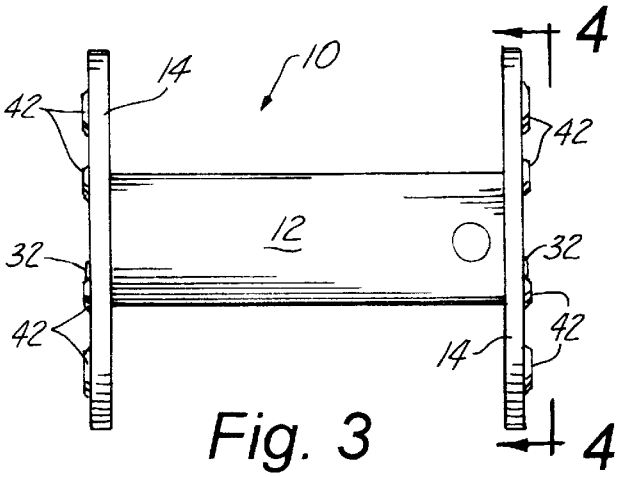
FIG. 3 is a side elevational view of the reel of FIG. 1.
Figure 4:
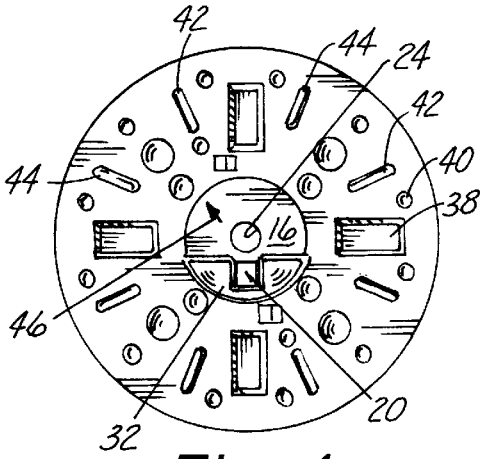
FIG. 4 is an end elevational view taken along line 4—4 of FIG. 3.
Figure 7:
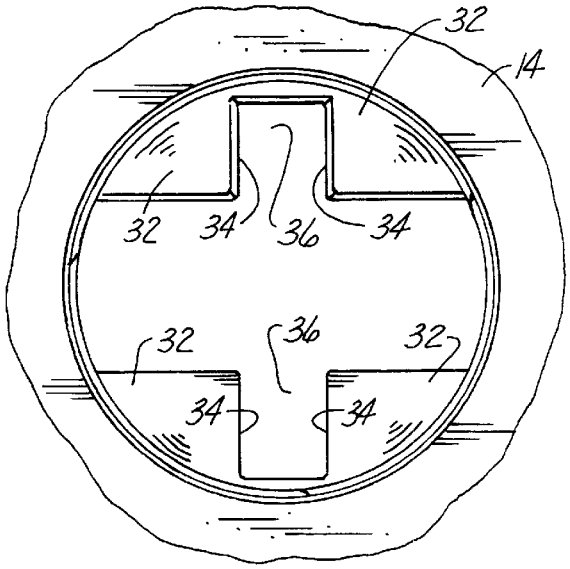
FIG. 7 is an enlarged partial side elevational view showing the relative positions of the webs when two flanges are nested together, outer face to outer face.
Figure 6:
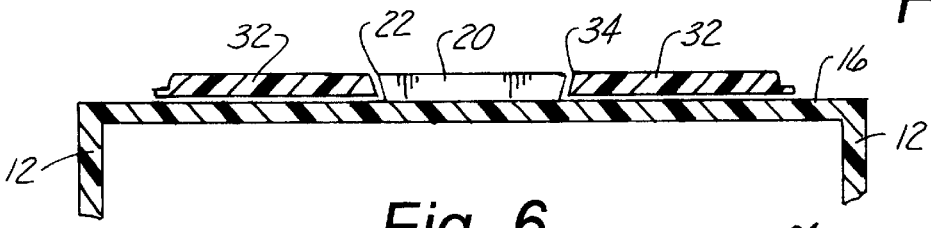
FIG. 6 is an enlarged sectional view taken along line 6—6 of FIG. 5.

Referring to FIGS. 3 and 4, it is noted that the flange 14 is hollow and has numerous depressions 38 and 40 for adding structural integrity to the flange 14. Raised portions 42 will nest into indentations 44 when the outer faces are juxtaposed so that these flanges 14 can be stacked for storage purposes. As shown in FIG. 7, the webs 20 of each flange 14 are received within the threaded openings 30 of the other flange 14. This nesting prevents one flange 14 from sliding with respect to the next flange 14 for storage purposes and will also aid in making them more compact for storage purposes.

Figure 5:
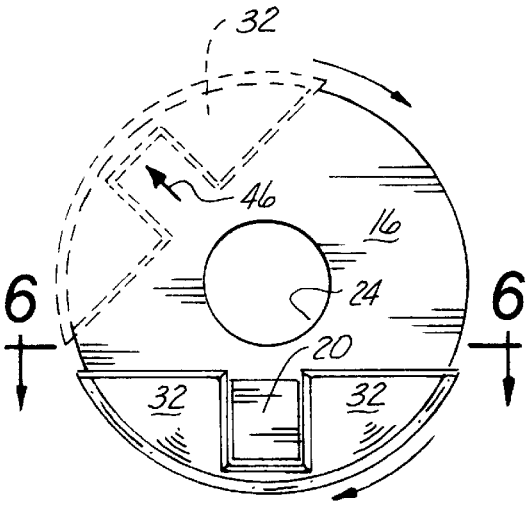
FIG. 5 is an enlarged side elevational view of a web portion of a flange in locking engagement with the tab of the core, and showing the web in dashed lines at the position to initiate threadable engagement with the core where the arrow indicator on the core end is located in the slot of the web.

Consequently, the flanges 14 can be stacked in one box and the cores 12 placed in another box and shipped either separately or together. When it is desired to assemble the reel 10, one of the cores 12 and two of the flanges 14 are used, for example, as shown in FIG. 2. Referring to FIG. 5 in the dashed lines, each of the flanges 14 is aligned properly by positioning the slot 36 of the web 32 so that arrow 46 carried on the core end 16 lies within the slot 36. The flange 14 is then threaded onto the core 12 turning it in the required direction.

Figure 8:
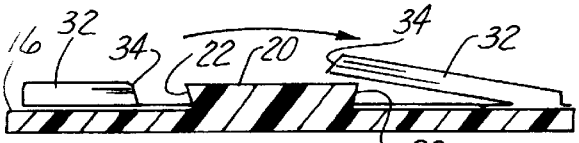
FIG. 8 is an enlarged partial sectional view similar to FIG. 6, but showing the web moving near the locked position with the tab.
Figure 9:
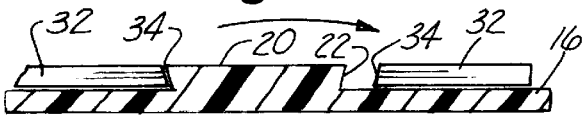
FIG. 9 is a sectional view similar to FIG. 8, but showing the web moved over the tab.
Figure 10:
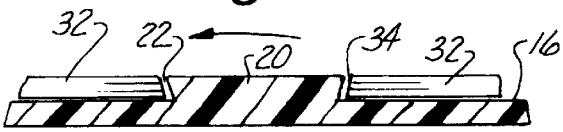
FIG. 10 is a sectional view similar to FIG. 9, but showing the web moved back to the locked position where the inclined edge of the web engages the inclined edge of the tab.

Once both flanges 14 have been threaded on the core 12 to the point where they are snug, the reel 10 is placed so that one of the flanges 14 is on the floor. The person assembling the reel 10 will then stand on the flat, upwardly facing portion of the floor engaging flange 14 while at the same time grasping the upper flange 14 to further turn the flange to tighten the threads onto the core 12. This will cause the leading edge 34 of the web 32 to move over the tab 20 (FIG. 8) until the trailing edge 34 contacts the leading edge 22 of the tab 20 (FIG. 9). When the direction of rotation of the flange 14 is reversed, the leading edge 34 of the web 32 contacts the trailing edge 22 of the tab 20 to lock the flange 14 and prevent inadvertent unthreading of the flange 14 with respect to the core 12 (FIG. 10). When in this locked position, the planar ends 16 of the core 12 are flush with the outer surface of the attached flanges 14.

Figure 11:
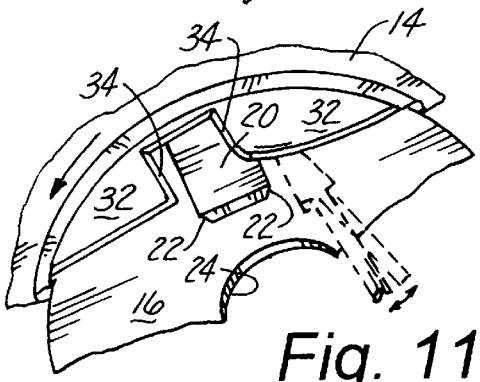
FIG. 11 is a partial side elevational view showing the web of a flange being pried up with a screwdriver so that it is disengaged from the tab on the end of the core.
Figure 12:
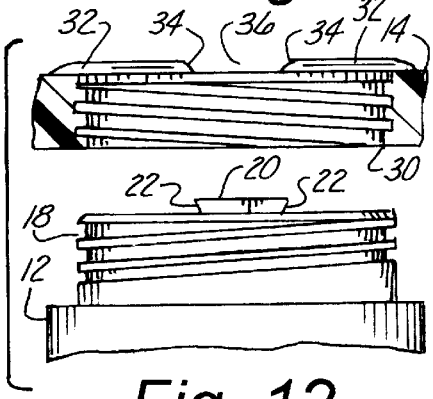
FIG. 12 is an exploded sectional view of a flange and core showing the flange disengaged from the core.

Of course if it is desired to take the flanges 14 off of the core 12, the leading edge 34 of the web 32 is pried up out of engagement with the trailing edge 22 of the tab 20 with a screwdriver as illustrated in FIG. 11. The flange 14 is then turned to unscrew the flange 14 from the core 12. This, of course, would be a very deliberate act, possible because the webs 32 are constructed of polyethylene plastic material which is resilient and forms a living hinge. The flanges 14 and core 12 would be held in the locked position shown in FIGS. 4 and 5 unless this deliberate act of unlocking is undertaken.

Accordingly it will be appreciated that the preferred embodiment disclosed herein does indeed accomplish the aforementioned objects. Obviously, many modifications and variations of the present invention are possible in light of the above teachings. It is therefore to be understood that, within the scope of the appended claims, the invention may be practiced otherwise than as specifically described.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

What is claimed is:

1. A reel assembly comprising:

a core having threaded ends, each end having a locking tab disposed outwardly from the threaded end, the locking tab including an inclined edge; and a pair of flanges, each flange adapted to be removably connected to one of the threaded ends of the core, each flange including a threaded opening and a resilient web spaced from an outer face of the flange and extending over a portion of the threaded opening, the web including an inclined edge, wherein full threadable engagement of the core and the flanges results in a lock fit between the locking tab inclined edge and the web inclined edge.

2. The reel assembly of claim 1 wherein the locking tab on each end of the core is disposed outwardly from the outer face of each of the flanges when the flanges and core are in full threadable engagement.

3. The reel assembly of claim 1 wherein the locking tab includes a pair of opposed inclined edges, and the web includes a pair of corresponding inclined edges forming an open slot disposed to receive the tab.

4. The reel assembly of claim 3 further including indicium carried on the core disposed to appear between the inclined edges of the slot when the flange is positioned to initiate threadable engagement with the core.

5. The reel assembly of claim 1 wherein the inclined edges of the tab and the web are inclined from vertical by about 15°.

6. The reel assembly of claim 1 wherein the web includes a recessed lip disposed coincident with a peripheral section of the threaded opening of the flange, wherein the pair of flanges are nestable when their outer faces are juxtaposed and the web of each flange is disposed within the threaded opening of the other flange.

7. The reel assembly of claim 1 wherein the core is hollow.

8. The reel assembly of claim 7 wherein the core is formed by blow-molding of plastic.

9. The reel assembly of claim 1 wherein the flanges are hollow.

10. The reel assembly of claim 9 wherein the flanges are formed by blow-molding of plastic.

* * * * *